United States Patent [19]

Ishikawa et al.

[11] 4,445,491

[45] May 1, 1984

[54] IGNITION SYSTEM FOR STARTING A DIESEL ENGINE

[75] Inventors: Yasuki Ishikawa; Hiroshi Endo, both of Yokosuka; Masazumi Sone, Tokyo; Iwao Imai, Yokosuka, all of Japan

[73] Assignee: Nissan Motor Company, Limited, Kanagawa, Japan

[21] Appl. No.: 408,701

[22] Filed: Aug. 16, 1982

[30] Foreign Application Priority Data

Aug. 27, 1981 [JP] Japan ..... 56-134592

[51] Int. Cl.[3] ..... F02P 5/00

[52] U.S. Cl. ..... 123/605; 123/143 B; 123/620; 123/596

[58] Field of Search ..... 123/605, 620, 640, 596, 123/143 B

[56] References Cited

U.S. PATENT DOCUMENTS

| | | | |
|---|---|---|---|
| 3,605,714 | 9/1971 | Hardin et al. | 123/605 |
| 4,111,173 | 9/1978 | Casey . | |
| 4,228,778 | 10/1980 | Rabus et al. | 123/605 |
| 4,301,782 | 11/1981 | Wainwright | 123/620 |
| 4,366,801 | 1/1983 | Endo et al. | 123/605 |
| 4,369,758 | 1/1983 | Endo | 123/605 |
| 4,398,526 | 8/1983 | Hamai et al. | 123/640 |

FOREIGN PATENT DOCUMENTS 2081810 2/1982 United Kingdom .

*Primary Examiner*—Parshotam S. Lall

*Attorney, Agent, or Firm*—Lowe, King, Price & Becker

[57] ABSTRACT

In an auxiliary ignition system for starting a diesel engine having a plurality of plasma spark plugs installed in corresponding combustion chambers facing fuel injection valves, starting time is reduced by applying high ignition energy to the plugs following predetermined time intervals after fuel injection to the corresponding engine cylinders.

4 Claims, 6 Drawing Figures

FIRST CYLINDER #1
THIRD CYLINDER #3
FOURTH CYLINDER #4
SECOND CYLINDER #2
ENGINE STARTING MOTOR
DC - DC CONVERTER
HALT
1500V
FROM M/M 21
13A
13B
13C
13D
N : 1
(1)
(2)
(3)
(4)

IGNITION SYSTEM FOR STARTING A DIESEL ENGINE

CROSS REFERENCE TO RELATED APPLICATIONS

The present application is related to application Ser. No. 333,014 filed on Dec. 21, 1981, application Ser. No. 370,821 filed on April 22, 1982, now abandoned and application Ser. No. 420,843 filed on Sept. 21, 1982.

BACKGROUND OF THE INVENTION

1. Field of the Invention

The present invention relates to an ignition system for immediately starting a diesel engine when an ignition key switch is placed at an engine start position for actuating a starting motor.

2. Background of the Invention

It is not necessary to install an ignition system into a diesel engine, since the diesel engine compresses injected fuel mixed with intake air and the compressed fuel ignites spontaneously. However, an auxiliary engine starting apparatus needs to be used for facilitating the engine start since it is difficult to start the engine particularly when an engine temperature is low.

A conventional auxiliary engine start apparatus comprises: (a) a low DC voltage supply such as a battery; and (b) an ignition key switch having a first contact connected to a pilot lamp and glow plugs each of which is located within a corresponding combustion chamber, second contact connected to an engine starting motor, third contact connected to an engine stop mechanism for engine stop, and fourth contact for engine continuous running. Each glow plug is located within a swirl chamber of the corresponding engine cylinder in a case of a swirl-chamber type diesel engine. Before starting the engine, the key switch is placed at the first contact position so as to supply the low DC voltage from the low DC voltage supply to the glow plugs. In several ten seconds after each glow plug starts to glow, the key switch is placed at the second contact position to actuate the engine starting motor. At this time, a given amount of fuel is injected into the swirl chamber to mix with a swirling intake air. Therefore, a spray of the injected fuel is brought in contact with the corresponding glow plug to ignite the injected fuel, the ignited fuel being injected into a main combustion chamber via an injection hole.

However, there is a problem in the conventional engine start system described above that it is inconvenient since the engine cranking need to be carried out after several ten seconds have elapsed to glow the glow plugs. In addition, there is another problem that since the glow plugs consume large power, the battery as the low DC voltage supply requires large power so that the conventional auxiliary engine start system has an unfavorable effect on the fuel consumption (the fuel consumption rate depends on the voltage level of the battery).

SUMMARY OF THE INVENTION

With the above-described problems in mind, it is an object of the present invention to provide an ignition system for facilitating the diesel engine start with small power consumption and for permitting an immediate engine start irrespective of the engine temperature.

This can be achieved by providing a spark plug within a corresponding combustion chamber of an engine cylinder (in a direct-injection type, a main combustion chamber, in a precombustion-type chamber, a precombustion chamber, and in a swirl-chamber type a swirl chamber) and feeding a high ignition energy into the spark plug in a predetermined interval of time (0.1 through 1 milliseconds) later than a given fuel injection timing of the corresponding engine cylinder, whereby the diesel engine can be started easily and immediately without failure when the engine is to be started in the cooling state.

BRIEF DESCRIPTION OF THE DRAWINGS

The features and advantages of the present invention will be appreciated from the foregoing description in conjunction with the attached drawings wherein like reference numerals designate corresponding elements and in which.

DETAILED DESCRIPTION OF THE PREFERRED EMBODIMENT

Reference will be made hereinafter to the attached drawings in order to facilitate understanding of the present invention.

Figure 1:
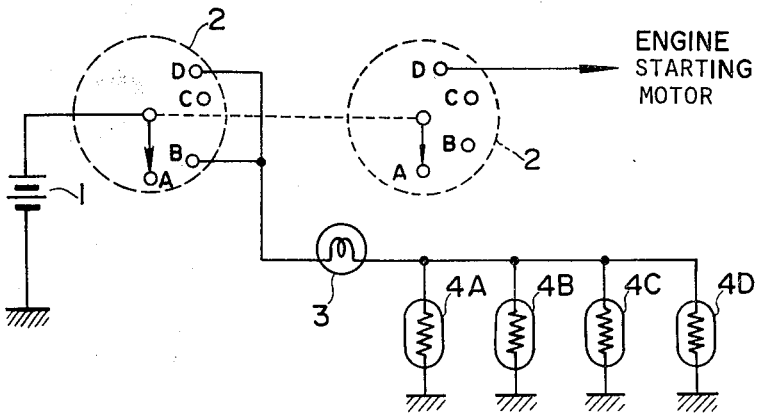
FIG. 1 PRIOR ART
FIG. 1 is a simplified circuit diagram of a conventional diesel engine auxiliary start system.

First in FIG. 1, showing a conventional engine start system of a diesel engine, numeral 1 denotes a low DC power supply such as a battery. Numeral 2 denotes an engine key switch of, e.g., a rotary doublepole switch type. The key switch 2 has four fixed contact positions A, B, C, and D: A denotes an engine stop contact position (OFF) to which a particular engine stop mechanism is connected (not shown), B denotes an engine preheating contact position to which a plurality of glow plugs 4A through 4D are connected in parallel, C denotes an engine continuous running position to which a load (not shown) is connected, and D denotes an engine start position to a second pole of which an engine starting motor (not shown) is connected. In the key switch 2, the contact B and a first pole of the contact D are connected to a pilot lamp 3 and four glow plugs 4A through 4D (in the case of four cylinders).

Figure 2:
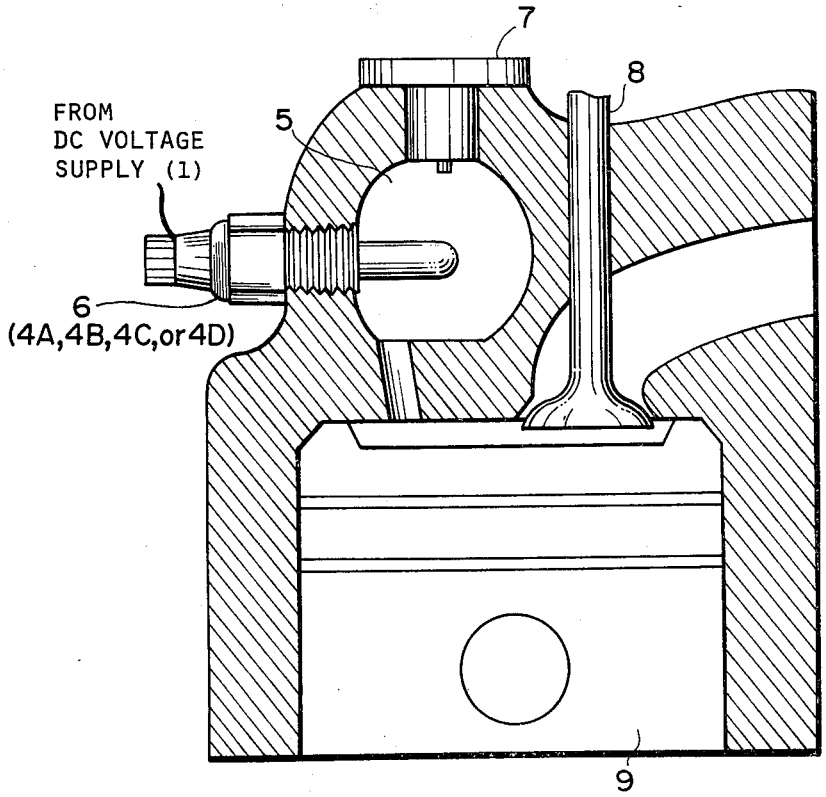
FIG. 2 PRIOR ART
FIG. 2 is a sectional view of a swirl-chamber type diesel engine wherein a glow plug shown in FIG. 1 is installed into the swirl chamber.

In FIG. 2, showing a swirl-chamber type diesel engine cylinder, numeral 5 denotes a swirl chamber, numeral 6 denotes a glow plug also shown in FIG. 1 installed in the swirl chamber 5, numeral 7 denotes a fuel injection valve, numeral 8 denotes an intake air suction valve, and numeral 9 denotes a piston.

When the key switch 2 is transferred from the contact A and placed at the preheating contact position B, a DC current from the low DC voltage supply 1 is sent into the glow plugs 4A through 4D. After each glow plug 4A through 4D shown in FIG. 1 glows in several ten seconds, the key switch 2 is, in turn, placed at the engine starting contact position D so as to rotate the starting motor. At this time, a given amount of fuel from the fuel injection valve 7 is injected into the swirl chamber 5 so as to bring part of injected fuel mixed with a swirling air into contact with the glow plug 6 shown in FIG. 2, the glow plug 6 being glowed. Consequently, the injected fuel ignites at the compression stroke of the engine piston 9.

Figure 3:
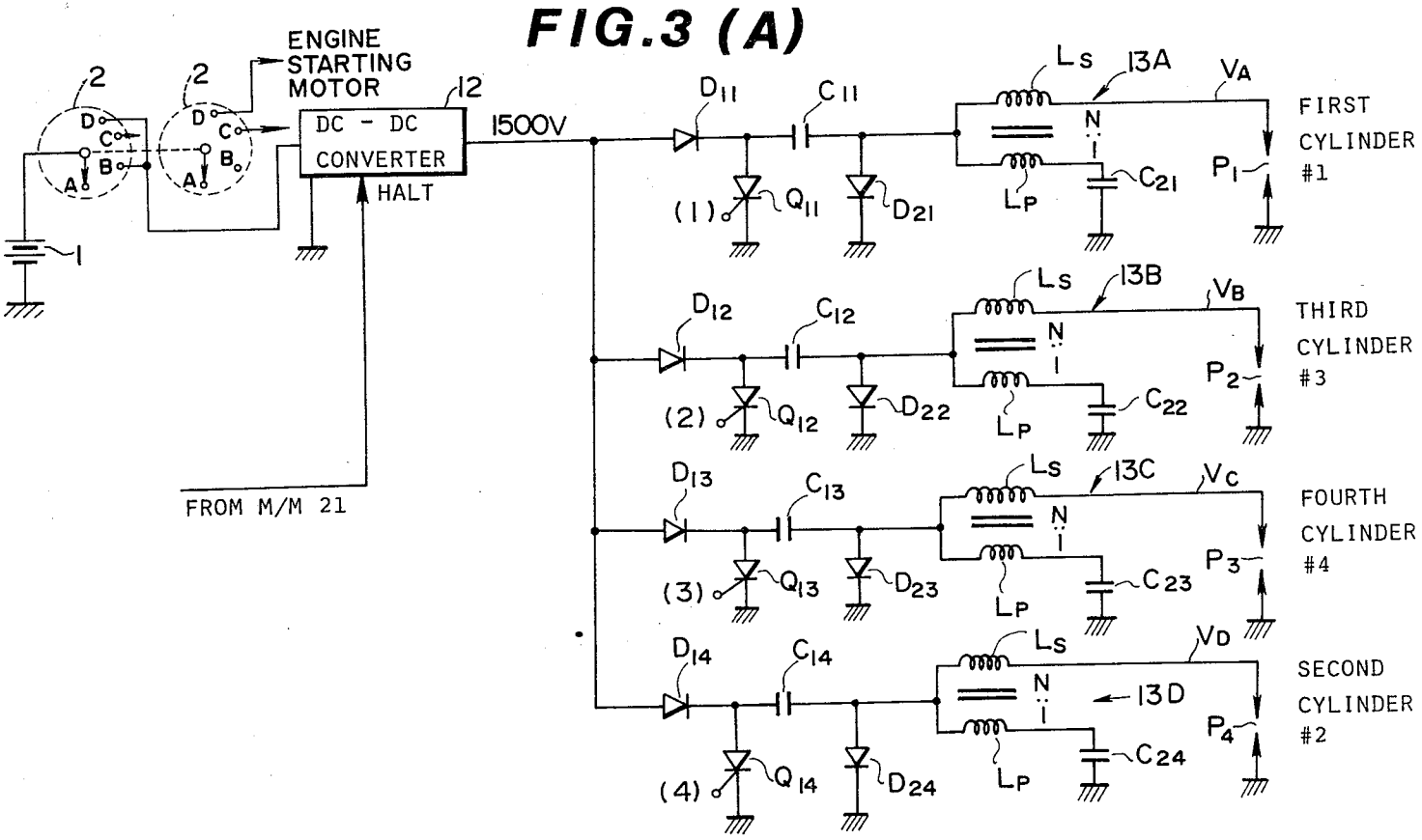
FIG. 3(A) and 3(B) are in combination a circuit diagram of an ignition system for auxiliarily starting a diesel engine showing a preferred embodiment according to the present invention.
Figure 3:
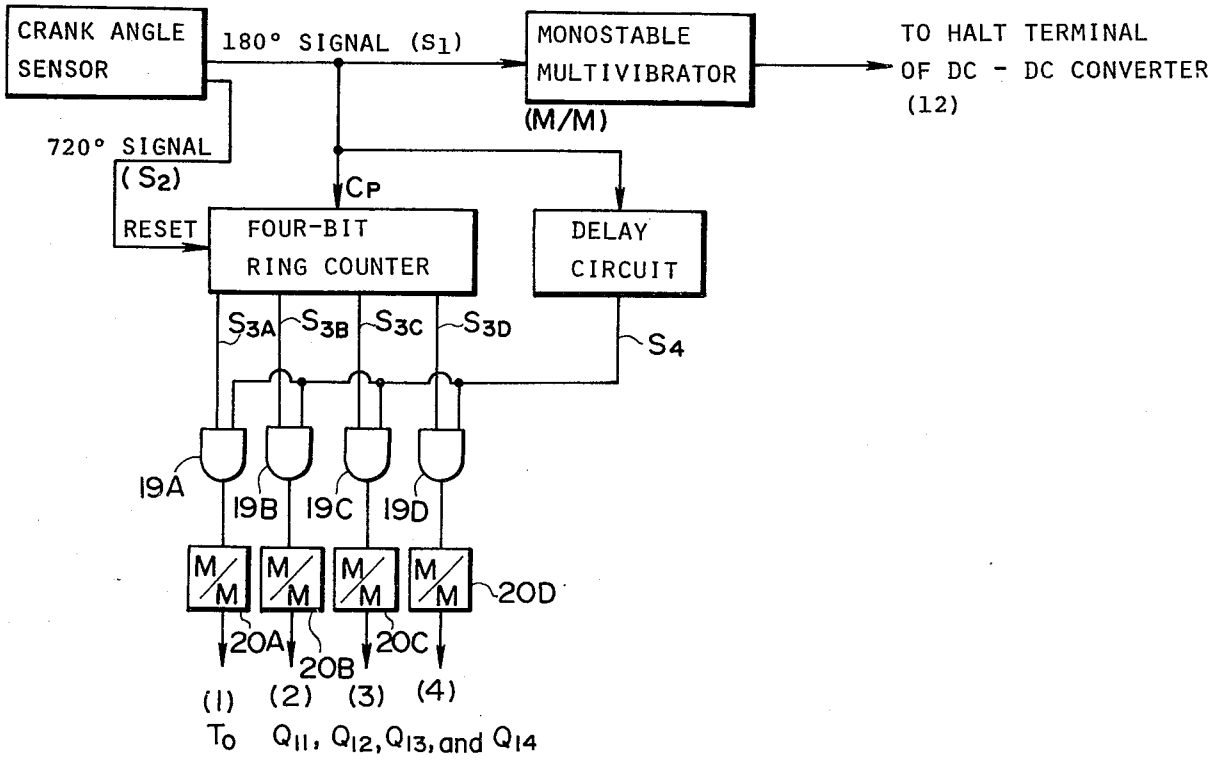

FIGS. 3(A) and 3(B) show a preferred embodiment of an auxiliary engine start ignition system for a diesel engine according to the present invention, particularly applied to a four-cylinder diesel engine.

In FIG. 3(A), symbols $P_1$ through $P_4$ denote spark plugs, each provided within the corresponding engine cylinder. The ignition order in the case of the four-cylinder engine is predetermined, i.e., first cylinder (#1), third cylinder (#3), fourth cylinder (#4), and second cylinder (#2). Numeral 12 denotes a DC—DC converter. The DC—DC converter 12 receives a low DC voltage, e.g., 12 volts from the DC voltage supply (battery) 11 when the ignition key switch 2 is transferred from the contact position A and placed at the contact position D, inverts the low DC voltage into a corresponding AC voltage, and boosts and rectifies the AC voltage into a high DC voltage, e.g., 1500 volts. It should be noted that when the ignition key switch 2 is placed at the contact position D, the starting motor (not shown) is actuated for the engine cranking and after engine cranking the ignition key switch 2 is returned to the contact position B until the fuel combustion is completely in the spontaneous ignitable condition. After entering in the spontaneous ignitable condition, the key switch 2 is placed at the contact position C.

Figure 4:
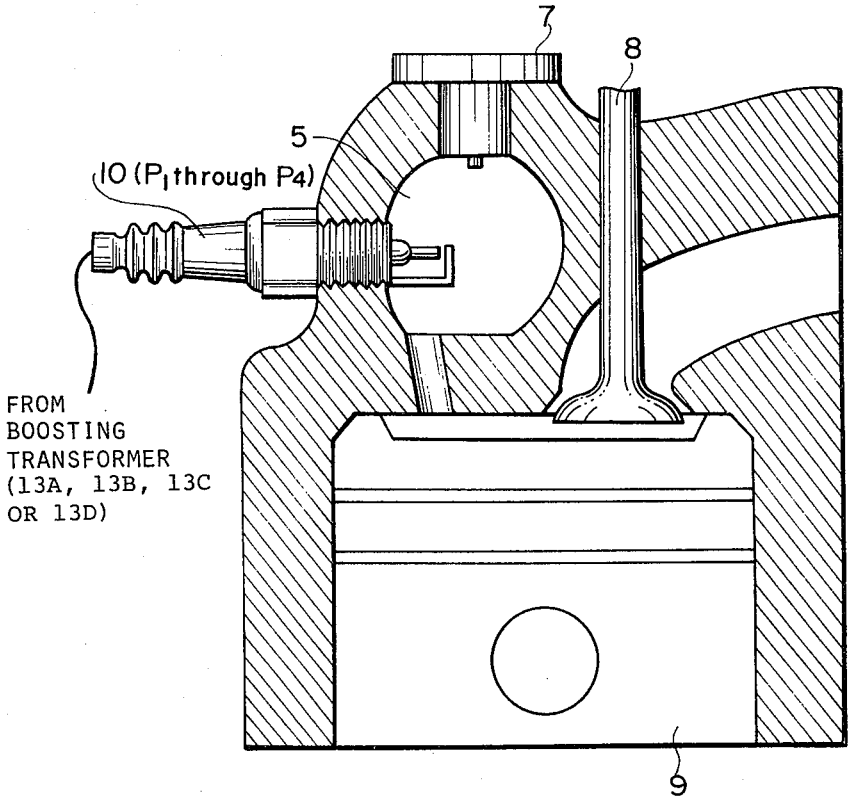
FIG. 4 is a sectional view of the swirl-chamber type diesel engine wherein a spark plug shown in FIG. 3(A) is installed into the swirl chamber.

FIG. 4 shows a partly sectioned diesel engine cylinder of the swirl chamber type, wherein a spark plug 10 (a representative spark plug shown in FIG. 3(A) as one of the spark plugs denoted by $P_1$ through $P_4$) is provided within one of the engine cylinders so that a discharge gap of the spark plug 10 is located within the swirl chamber 5.

The discharge gap faces toward the injection valve 7.

An ignition circuit is provided for each engine cylinder. The ignition circuit comprises: (a) a first diode $D_{11}$ through $D_{14}$ whose cathode is connected to the DC/DC converter 12; (b) a first capacitor $C_{11}$ through $C_{14}$ for charging the high DC voltage from the DC/DC converter 12 via the first diode $D_{11}$ through $D_{14}$; (c) a second diode $D_{21}$ through $D_{24}$ whose anode is grounded and cathode is connected to one end of the first capacitor $C_{11}$ through $C_{14}$; (d) a semiconductor switching element, $Q_{11}$ through $Q_{14}$ (in this embodiment a reverse-blocked triode thyristor $Q_{11}$ through $Q_{14}$ is used), one terminal (cathode) being connected to the anode of the corresponding first diode $D_{11}$ through $D_{14}$, the other terminal (anode) being grounded, and drive terminal (gate) being connected to an ignition signal generator to be described hereinbelow. The ignition signal generator, as shown in FIG. 3(B), comprises: (a) a crank angle sensor 15 which outputs a 180° signal ($S_1$) having a period corresponding to 180 degrees through which an engine crankshaft has rotated. A fuel injection valve 7 shown in FIG. 4 opens so as to inject fuel into the swirl chamber 5 simultaneously whenever the crank angle sensor 15 outputs the 180° singal $S_1$. The period of the signal $S_1$ is predetermined according to the number of engine cylinders, e.g., 90° in the case of an eight-cylinder engine. The crank angle sensor 15 outputs a 720° signal $S_2$ having a period corresponding to 720° through which the engine crankshaft has rotated, i.e., corresponding to one engine cycle. The ignition signal generator comprises: (b) a four-bit ring counter which receives the 180° signal $S_1$ from the crank angle sensor 15 at its clock terminal CP, outputs four pulse signals $S_{3A}$ through $S_{3D}$ circularly at its four output terminals, and reset by the 720° signal $S_2$ received from the crank angle sensor 15, each output pulse signal $S_{3A}$ through $S_{3D}$ has a pulsewidth corresponding to 180° of the rotational angle of the engine crankshaft. The four output terminals are connected to AND gate circuits 19A through 19D, respectively. The output terminals of the respective AND gate circuits 19A through 19D are connected to the respective monostable multivibrators M/M 20A through 20D. The 180° signal $S_1$ is also sent into a delay circuit 18 which outputs a pulse signal in a predetermined time of delay $\tau_1$ (0.1 milliseconds through 1 millisecond) whenever the 180° signal $S_1$ is received. The output terminal of the delay circuit 18 is connected to the four AND gate circuits 19A through 19D. Each AND gate circuit 20A through 20D is connected to a corresponding monostable multivibrator 20A through 20D. Each monostable multivibrator 20A through 20D outputs an ignition pulse signal (1) through (4) having a predetermined pulsewidth (e.g., 100 microseconds) in response to the inputted delayed pulse signal from the corresponding AND gate circuit 19A through 19D. The ignition pulse signal (1) through (4) is consequently sent from one of the monostable multivibrators M/M 20A through 20D into the corresponding switching element (thyristor) $Q_{11}$ through $Q_{14}$ at its drive (gate) terminal. It should be noted that the crank angle sensor 15 may be attached to a fuel injection pump so that the 180° signal $S_1$ and 720° signal $S_2$ are outputted at an interval equal to that between fuel injection timings of all engine cylinders and at an interval equal to that of the fuel injection timing of a particular engine cylinder.

Figure 5:
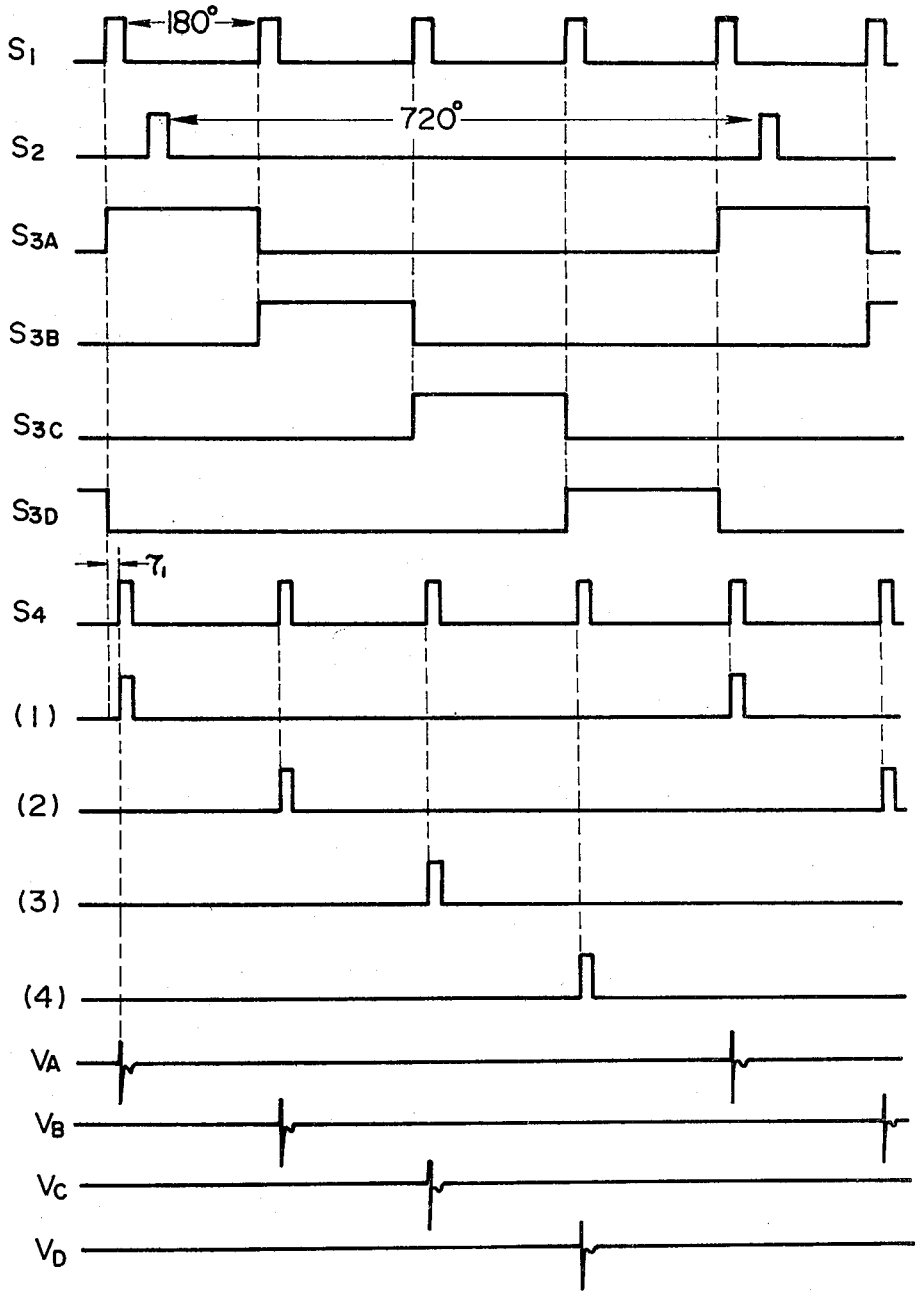
FIG. 5 is a signal timing chart of the auxiliary engine start ignition system shown in FIGS. 3(A) and 3(B).

FIG. 5 shows a signal timing chart of each main circuit shown in FIGS. 3(A) and 3(B).

It should be noted that the four-bit ring counter 17 is reset when the 720° signal $S_2$ is received at the reset terminal thereof. Therefore, a correct judgement of the engine cylinder to be ignited can be made according to the predetermined ignition order. It should also be noted that the 180° signal $S_1$ is also sent from the crank angle sensor 15 to another monostable multivibrator 21. The monostable multivibrator 21 outputs a pulse signal having a predetermined pulsewidth, e.g., 1 millisecond into a halt terminal of the DC/DC converter 12 whenever the 180° signal $S_1$ is received from the crank angle sensor 15 so that the DC/DC converter 12 halts the output of the high DC voltage during a time interval corresponding to the pulsewidth of the output signal from the monostable multivibrator 21.

For example, when the first thyristor $Q_{11}$ is turned off, the high DC voltage of 1500 volts is fed into the first capacitor $C_{11}$ (e.g., 1 microfarad) via the first and second diodes $D_{11}$ and $D_{21}$ so that the first capacitor $C_{11}$ charges a charging energy of approximately 1 Joule. In this state, the ignition pulse signal (1) is sent to the first thyristor $Q_{11}$ so that the thyristor $Q_{11}$ turns on. When the thyristor $Q_{11}$ turns on, a point between the left end of the first capacitor $C_{11}$ is abruptly grounded and the right end of the first capacitor $C_{11}$ turns to minus 1500 volts. Therefore, the second capacitor $C_{21}$ and primary winding Lp receive a discharge current from the first capacitor $C_{11}$ via the thyristor $Q_{11}$. The capacitance of the second capacitor $C_{21}$ is lower than that of the first capacitor $C_{11}$.

The primary winding Lp and serially connected second capacitor $C_{21}$ of the boosting transformer 13A produces a damping oscillation when the thyristor $Q_{11}$ turns on and the discharge current is received. Since the winding ratio of the boosting transformer 13A is 1:N, the secondary winding Ls generates a multiplied damped voltage (20 through 30 kilovolts) according to the winding ratio of the boosting transformer 13A. The first spark plug $P_1$ generates a spark discharge due to the application of such high damped voltage. In this way, when the spark discharge occurs and the discharge gap of the first spark plug $P_1$ becomes conductive, the remaining energy charged within the first capacitor $C_{11}$ and the energy fed into the second capacitor $C_{21}$ are fed into the first spark plug $P_1$ via the boosting transformer 13A in a very short period of time. At this time, a plasma gas is generated abound the discharge gap of the first spark plug $P_1$ so that the fuel injected into the swirl chamber 5 shown in FIG. 4 is fired.

Such an ignition operation is performed whenever the ignition pulse signal (1) through (4) is sent sequencially into the corresponding switching element (thyristor) $Q_{11}$ through $Q_{14}$ of each ignition circuit. As an alternative of each thyristor $Q_{11}$ through $Q_{14}$, a power transistor circuit may be used.

It should be noted that an interval of time from the time when the fuel injection valve 7 injects fuel to the time when a spray of injected fuel arrives around the discharge gap of the spark plug does not depend on the engine revolutional speed but depends on the dimension of the engine, particularly the distance between the fuel injection valve 7 and discharge gap of the spark plug 10 as shown in FIG. 4.

Therefore, according to the present invention, the ignition of each spark plug $P_1$ through $P_4$ is performed in the predetermined time (0.1 milliseconds through 1 millisecond) of delay $\tau_1$ after the injection of fuel is carried out at the corresponding cylinder in respect of the arrival of a spray of injected fuel around the discharge gap of the spark plug 10.

In addition, since the ignition system performs a high energy ignition by means of the plasma gas, a stable combustion of such fuel having a high ignition temperature characteristic as light oil can be made without misfire.

Described hereinbelow is a difference in an energy consumption between the conventional engine start system shown in FIG. 1 and the start system according to the present invention.

If the glow plug having a power consumption rating of 35 Watts shown in FIG. 2 glows for ten seconds to perform the engine cranking of five seconds, the energy consumed during that interval is 2100 Joules.

Whereas the engine start system according to the present invention consumes approximately 67 Joules supposing that the energy charged within the first capacitor $C_1$ for one ignition is 1 Joule, and the conversion efficiency from the electric power consumption of the low DC voltage supply 1 to the ignition energy is 50 percent when the engine cranking of 200 rpm is performed for five seconds during the engine start. It will be appreciated that the energy consumption is reduced about one-thirtieth of the conventional glow-plug engine start system.

Therefore, the DC voltage supply, i.e., vehicle battery consumes a lesser amount of energy so that the charging energy for the battery can be reduced. Consequently, the fuel consumption rate is correspondingly reduced.

Since it is not necessary to preheat the spray of injected fuel before the engine cranking, it is not necessary for an engine operator to wait several seconds through ten seconds for the engine cranking. The engine cranking can be carried out simply by setting the key switch 2 directly at its start position (contact position D) in the same way as a conventional gasoline engine.

Furthermore, since in the diesel engine, the injected fuel is spontaneously ignited by means of a compression of intake air after the engine has started, a stop circuit may be provided in the ignition system which automatically halts the overall auxiliary engine start ignition system when the fuel combustion is completely transferred in the spontaneously ignitable state (e.g., a circuit which automatically turns off the low DC voltage supply, i.e., battery when the output voltage level of an alternator (alternating current generator) which generates an AC voltage having a peak value corresponding to the engine revolutional speed exceeds a predetermined value).

However, when the engine is started at a low temperature, the ignition operation of the engine start ignition system needs to continue until the temperature remarkably increases even after the fuel combustion is transferred in the spontaneous ignition in order to provide a stable engine revolution. Therefore, the ignition system may be constructed so as to continue the ignition operation until the engine temperature arrives at a constant high temperature, until a predetermined period of time has passed, or until the engine revolutional speed arrives at a predetermined speed value. If the ignition system is so constructed as described above, the key switch 2 may not need to transfer from the contact position B to the contact position C.

According to the present invention, since the engine can immediately be started simply by setting an ignition key switch at a start position, a wasteful time to wait for each glow plug to glow up for the engine cranking is eliminated. Therefore, the engine start operation is simplified. In addition, a considerable amount of the consumed electric power of the battery (DC voltage supply) can be saved and the fuel consumption rate can accordingly be reduced.

It will fully be understood by those skilled in the art that the foregoing description is in terms of preferred embodiments of the present invention wherein various modifications and changes may be made without departing from the spirit and scope of the present invention, which is to be defined by the appended claims.

What is claimed is:

1. An ignition system for auxiliarily starting a multicylinder diesel engine having a low DC voltage supply unit which includes a DC battery and ignition key switch connected to said DC battery, comprising:

(a) a plurality of plasma spark plugs, each installed within a corresponding combustion chamber so as to expose a discharge gap thereof to a spray of injected fuel from a corresponding injection valve;

(b) a DC—DC converter which boosts a low DC voltage from said low DC voltage unit into a high DC voltage when said ignition key switch is placed at a start position for actuating an engine starting motor and placed at an ignition position for continuously supplying the low DC voltage from said DC battery thereinto;

(c) a plurality of energy charging sections each having a first diode connected to said DC—DC converter, a first capacitor a first end thereof being connected to said first diode, and a second diode being connected between a second end of said first capacitor and ground and each of which charges the high DC voltage into said first capacitor;

(d) a plurality of switching elements, each connected between said first capacitor and ground which operatively turns on to ground the first end of said first capacitor so as to discharge the energy charged within said first capacitor therethrough;

(e) a plurality of voltage boosting sections, each connected between said corresponding energy charging section and spark plug and having a transformer and second capacitor, one end of a primary winding of said transformer being connected to the second end of said first capacitor together with a first end of a secondary winding thereof, a second end of said primary winding being grounded via said second capacitor so as to generate a damping oscillation when said corresponding switching element turns on to apply the charged high DC voltage thereacross, and the second end of said secondary winding being connected to the corresponding spark plug thereof so as to supply a discharge energy into the corresponding spark plug; and (f) an ignition signal generator which detects a fuel injection timing of each engine cylinder, generates and outputs an ignition pulse signal having a predetermined time of delay with respect to the fuel injection timing of the corresponding engine cylinder into said corresponding switching element to turn on said switching element and generates and outputs another pulse signal at the fuel injection timings of all engine cylinders having a predetermined pulsewidth to said DC—DC converter so as to temporarily halt the output of the boosted high DC voltage during each time interval predetermined by the pulsewidth of said pulse signal, whereby the engine starts immediately by turning said ignition key switch to the start position.

2. An ignition system as set forth in claim 1, wherein said ignition signal generator outputs the ignition pulse signal having said predetermined time of delay based on an interval of time during which the injected fuel from the injection valve arrives at said corresponding spark plug.

3. An ignition system as set forth in claim 1 or 2, wherein said predetermined time of delay is in a range from 0.1 milliseconds to 1 millisecond.

4. An ignition system as set forth in claim 1, wherein said ignition signal generator comprises:

(a) a first means which generates and outputs a first signal whenever the fuel injection timing for every engine cylinder is reached;

(b) a second means which generates and outputs a second signal whenever the fuel injection timing for a particular engine cylinder is reached;

(c) a multi-bit ring counter having bits of the same number as that of the engine cylinder which counts the number of said first signal and reset by said second signal;

(d) a third means which outputs a third signal having the predetermined time of delay in response to said first signal from said first means;

(e) a plurality of AND gate circuits equal in number to the engine cylinders, each one of two input terminals receiving an output signal from the corresponding bit output of said ring counter and remaining input terminal receiving said third signal from said third means; and (f) a plurality of monostable multivibrators, each connected to said corresponding AND gate circuit for outputting the ignition pulse signal into said corresponding switching element in response to the output signal of said corresponding AND gate circuit.

* * * * *